US007607331B2

(12) United States Patent
Carsley et al.

(10) Patent No.: US 7,607,331 B2
(45) Date of Patent: Oct. 27, 2009

(54) METHOD AND APPARATUS FOR HEMMING PANELS TOGETHER

(75) Inventors: John E. Carsley, Clinton Township, MI (US); Anil K. Sachdev, Rochester Hills, MI (US); Richard M. Kleber, Clarkston, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 328 days.

(21) Appl. No.: 11/669,969

(22) Filed: Feb. 1, 2007

(65) Prior Publication Data

US 2008/0184760 A1 Aug. 7, 2008

(51) Int. Cl.
*B21D 11/00* (2006.01)

(52) U.S. Cl. ..... 72/306; 72/316; 72/322; 72/220

(58) Field of Classification Search ..... 72/210, 72/214, 220, 306, 312, 316, 319, 322, 323, 72/404, 446, 447; 29/243.5, 243, 58, 243.57
See application file for complete search history.

(56) References Cited

U.S. PATENT DOCUMENTS

| | | | | |
|---|---|---|---|---|
| 5,611,133 | A | 3/1997 | Toeniskoetter | 29/509 |
| 5,752,304 | A | 5/1998 | Toeniskoetter | 29/243.58 |
| 5,761,947 | A * | 6/1998 | Barnes | 72/203 |
| 6,154,942 | A | 12/2000 | Toeniskoetter | 29/243.58 |
| 6,161,410 | A * | 12/2000 | Shook et al. | 72/220 |
| 6,477,879 | B1 | 11/2002 | Sawa | 72/220 |
| 6,640,601 | B2 | 11/2003 | Hatty | 72/312 |
| 6,810,707 | B2 * | 11/2004 | Friedman et al. | 72/220 |
| 7,134,309 | B2 * | 11/2006 | Toeniskoetter | 72/306 |
| 7,204,116 | B2 * | 4/2007 | Heringshausen | 72/214 |
| 2004/0206149 | A1 | 10/2004 | Hario et al. | |
| 2005/0284204 | A1 | 12/2005 | Carsley | |
| 2006/0179914 | A1 * | 8/2006 | Tocco | 72/447 |

FOREIGN PATENT DOCUMENTS

| | | | |
|---|---|---|---|
| JP | 04-351227 | | 12/1992 |
| JP | 6-344037 | * | 12/1994 |
| JP | 2000-237830 | | 9/2000 |
| JP | 2000-237831 | * | 9/2000 |

OTHER PUBLICATIONS

PCT International Search Report, PCT/US2008/052738.
Written Opinion of the International Searching Authority,, PCT/US2008/052738.

* cited by examiner

*Primary Examiner*—Edward Tolan

(57) ABSTRACT

Method and apparatus hems the edges of inner and outer panels by bending a peripheral flange of the outer panel over edge portions of the inner panel to form a panel assembly. A press apparatus has a lower platen and an upper platen. The outer panel is placed onto the lower platen and the inner panel is placed onto the lower panel with the peripheral flange of the outer panel surrounding the inner panel. The upper platen is lowered to capture the inner panel atop the outer panel. A first portion of the peripheral flange is hemmed by closing hemming dies over the first portion of the peripheral flange to bend the flange onto the inner panel. A second portion of the peripheral flange is hemmed by passing a hemming roller mechanism along the second portion of the peripheral flange to bend the flange onto the inner panel.

17 Claims, 2 Drawing Sheets

METHOD AND APPARATUS FOR HEMMING PANELS TOGETHER

FIELD OF THE INVENTION

The present invention relates to joining the edges of inner and outer body panels by a hemmed joint, and more particularly to the use of roller hemming and die hemming in a single press.

BACKGROUND OF THE INVENTION

It is known in the manufacture of motor vehicle panels, for example an engine compartment hood, to attach an inner panel and an outer panel via a hemmed joint in which a flange provided on the outer panel is bent over an edge portion of the inner panel.

As one alternative, the prior art employs press-mounted hemming dies to bend the outer panel flange over the edge portion of the inner panel.

As another alternative, the prior art employs a robot to move rollers around the periphery of the outer panel to bend the outer panel flange over the edge portion of the inner panel.

It would be desirable to obtain improvements in the apparatus and method for forming hem joints in order to improve manufacturing efficiencies and improve product quality.

SUMMARY OF THE INVENTION

Method and apparatus is provided for hemming the edges of inner and outer panels by bending a peripheral flange of the outer panel over edge portions of the inner panel to form a panel assembly. A press apparatus has a lower platen and an upper platen. The outer panel is placed onto the lower platen and the inner panel is placed onto the lower panel with the peripheral flange of the outer panel surrounding the inner panel. The upper platen is lowered to capture the inner panel atop the outer panel. A first portion of the peripheral flange is hemmed by closing hemming dies over the first portion of the peripheral flange to bend the flange onto the inner panel. A second portion of the peripheral flange is hemmed by passing a hemming roller mechanism along the second portion of the peripheral flange to bend the flange onto the inner panel.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiments is merely exemplary in nature and is not intended to limit the invention, its application, or uses.

Figure 1:
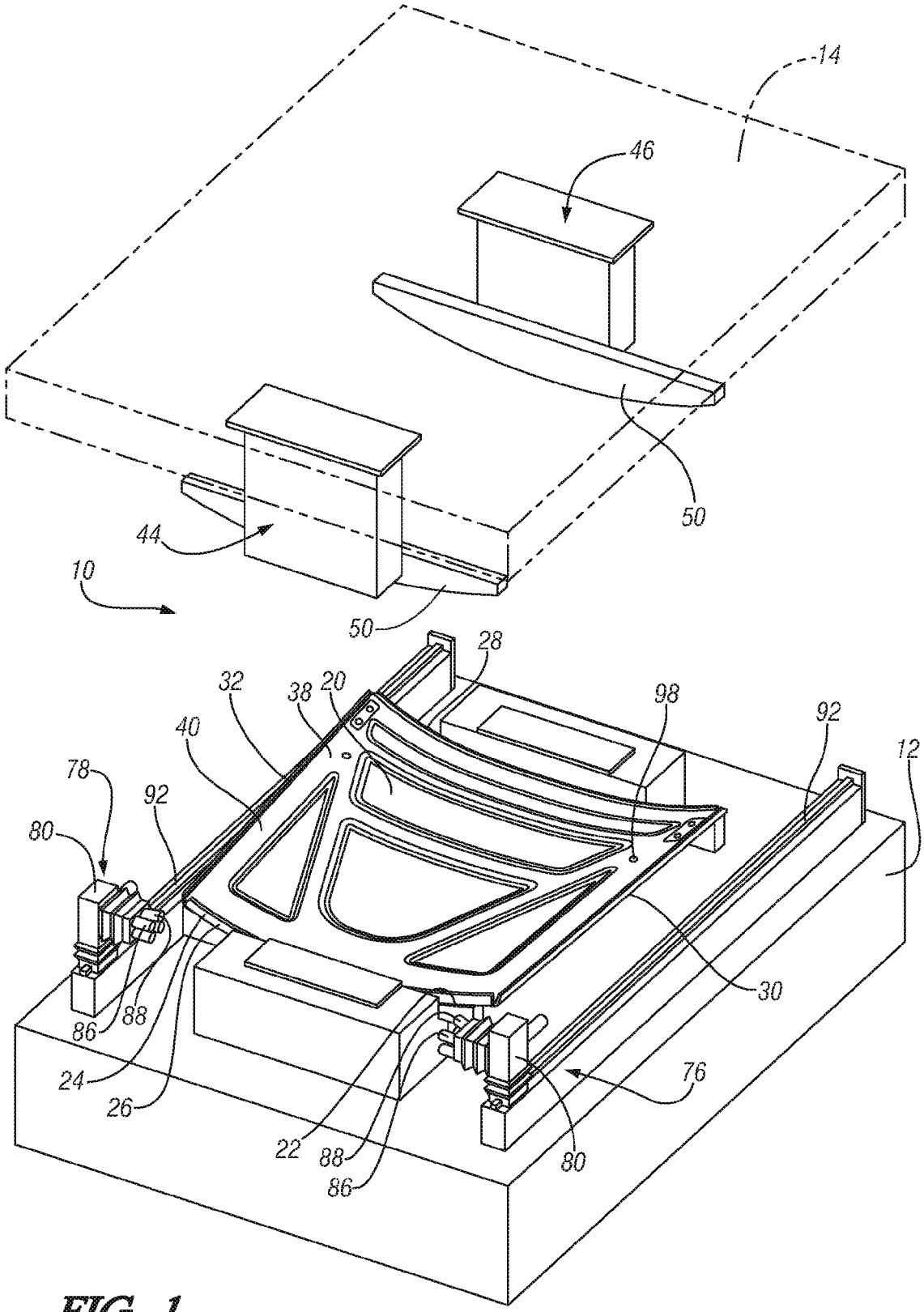
FIG. 1 is a perspective view of a press apparatus according to the invention, showing the press in the open position with the upper platen raised above the lower platen.
Figure 2:
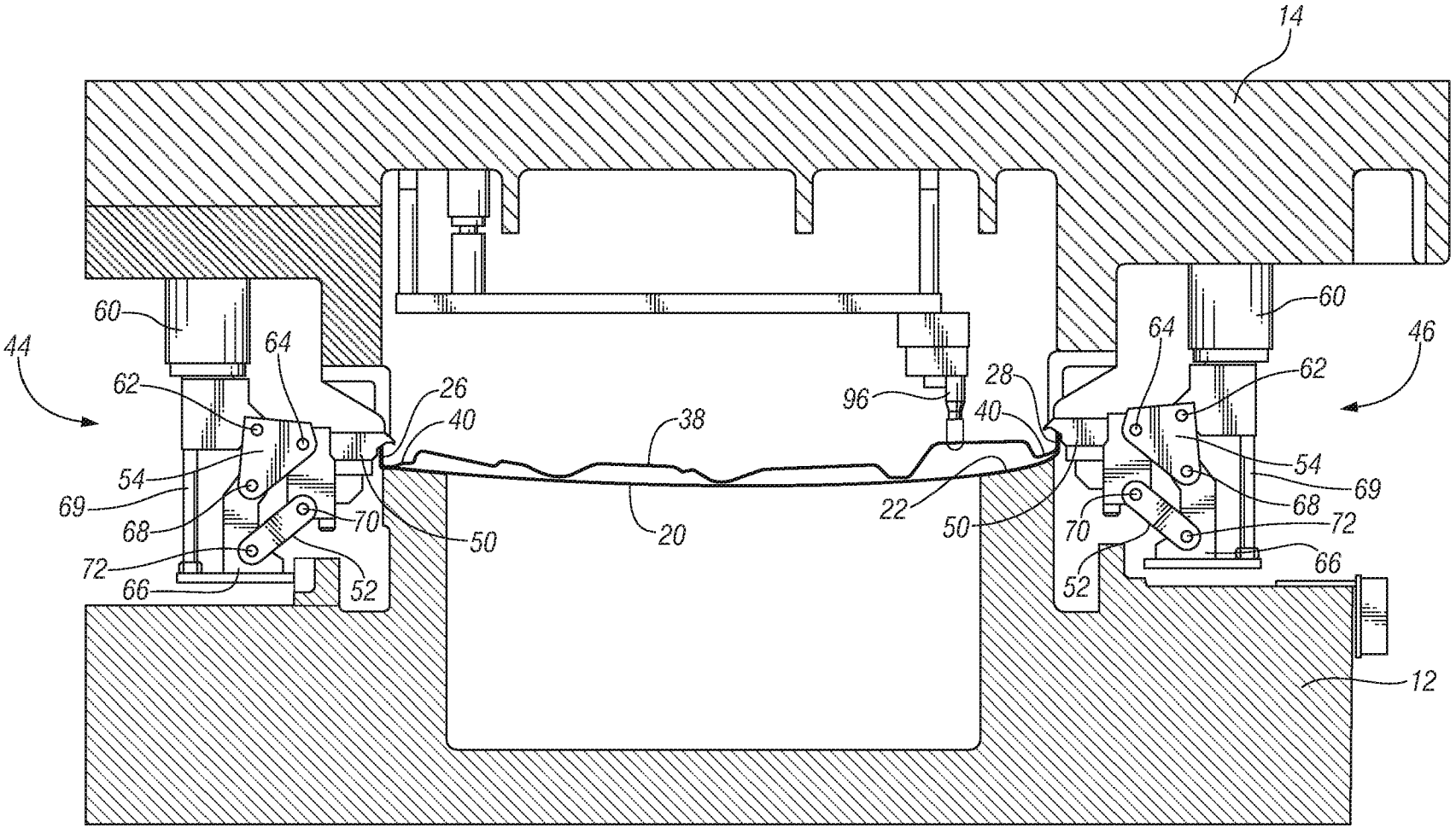
FIG. 2 is a section view through the press apparatus of FIG. 1 but showing the press approaching the fully closed position in which the upper platen is being lowered onto the lower platen.

Referring to FIGS. 1 and 2, a press apparatus, generally indicated at 10, includes a lower platen 12 and an upper platen 14. The press apparatus 10 may be a hydraulic press or a mechanical press. In the press apparatus, a mechanism, not shown, will open and close the press by raising and lowering the vertically movable upper platen 14 relative to the stationary lower platen 12.

As best seen in FIG. 2, an outer panel 20, of generally rectangular shape has four side edges and rests upon a die surface 22 of the lower platen 12. The outer panel 20 has a peripheral flange 24 extending around the four side edges including a front flange 26, rear flange 28, right side flange 30 and left side flange 32. An inner panel 38 is placed upon the outer panel 20 and has a peripheral edge portion 40 that rests upon the outer panel 20. The inner panel 38 is located and held within the outer panel 20 by the peripheral flange 24.

It will be understood that the inner panel 38 and the outer panel 20 are to be joined together by hemming the peripheral flange 24 over the edge portion 40 of the inner panel 38, to thereby form a hood assembly.

Referring to FIG. 1, is seen that the upper platen 14 carries a front hemming die mechanism 44 and a rear hemming die mechanism 46, which are shown in greater detail in FIG. 2. In particular, as seen in FIG. 2, the front hemming die mechanism 44 includes a die blade 50 that overlies the front flange 26 and is operated by lower toggle link 52 and upper toggle link 54. The upper toggle link 54 is connected to a support leg 60 of the upper platen 14 by a pivot 62. The upper toggle link 54 is also connected to the die blade 50 by a pivot 64 and to an actuator foot 66 by a pivot 68. The lower toggle link 52 is connected to the die blade 50 by a pivot 70 and to the actuator foot 66 by a pivot 72. The actuator foot 66 is mounted on the support leg 60 by a telescoping strut mechanism 69 so that the actuator foot 66 can move vertically relative the support 60 of the upper platen 14 to actuate the die blade 50 via the toggle links 52 and 54 as will be described in detail hereinafter. The rear hemming die mechanism 46 is constructed similar to the front hemming die mechanism 44 and has like elements designated by like numerals.

Referring to FIG. 1, it is seen that the lower platen 12 has a right roller hemming mechanism, generally indicated at 76, and a left roller hemming mechanism, generally indicated at 78. In particular, the right roller hemming mechanism 76 includes a multi-axis manipulator 80 that mounts a pair of hemming rollers 86 and 88. The multi-axis manipulator 80 rides on a track 92 mounted on the lower platen 12 and extending along side the outer panel 20. The left roller hemming mechanism 78 is constructed similar to the right roller hemming mechanism 76 and has like elements designated by like numerals.

Operation

Referring to FIG. 1, it is seen that the press apparatus 10 is in the open position with the upper platen 14 raised above the lower platen 12, and the roller hemming mechanisms 76 and 78 are full forward on their respective tracks 92. With the press apparatus 10 open, the outer panel 20 has been loaded onto the lower platen 12 and is supported upon the die surface 22 of the lower platen 12. The inner panel 38 has been loaded onto the outer panel 20 and the peripheral flange 24 of the outer panel 20 locates and holds the position of the inner panel 38.

In FIG. 2, the upper platen 14 is being lowered onto the lower platen 12. A spring loaded locating pin 96 carried by the upper platen 14 has entered into a locating hole 98 (shown in FIG. 1) of the inner panel 38 to secure the location of the inner panel 38. After engaging within the locating hole 98, the locating pin 96 can yield in length as the upper platen 14 continues to be lowered. Additional of these and other known locating pin arrangements will be employed to precisely locate and hold the inner panel 38 at a precise location within the outer panel 20.

In FIG. 2, the lowering of the upper platen 14 has lowered the front and rear hemming dies 44 and 46 so that the die blades 50 overlie respectively the front flange 26 and the rear flange 28 of the outer panel 20. Upon further lowering of the upper platen 14 from the position of FIG. 2, the actuator foot 66 engages with the lower platen 12 so that the ongoing lowering of the upper platen 14 causes the toggle links 52 and 54 to pivot the die blade 50 onto the front and rear flanges 26 and 28 to bend the flanges 26 and 28 onto the outer edge portion 40 of the inner panel 38 as the upper platen 14 reaches its fully lowered position. Thus the front and rear edges of the hood assembly are joined by the hemming dies as the press apparatus 10 is closed.

Referring again to FIG. 1, the side edges of the hood assembly will be hemmed together by the right roller hemming mechanism 76 and the left roller hemming assembly 78 while the front and rear hemming die mechanisms 44 and 46 continue to press upon the hemmed together front and rear edges of the hood assembly and thereby clamp the outer panel 20 securely in place upon the die surface 28 of the lower platen 12 during the roller hemming operation. In particular, the multi-axis manipulators 80 will be moved rearwardly along the track 92 from the forward position of FIG. 1, while the rollers 86 and 88 progressively bend the side flanges 30 and 32 onto the inner panel 38 as the multi-axis manipulators 80 move rearwardly along the tracks 92. The press apparatus is equipped with switches and controls that will initiate the roller hemming operation in response to the completion of the hemming die operation, as sensed by the upper platen having reached the fully lowered position. It will be understood and appreciated that the multi-axis manipulators will articulate the rollers up and down and in and out as needed to cause the rollers to follow along the curved shape of the outer panel 20, however, in some applications, with less complex panel shape, the roller mechanisms may be mounted via a track mechanism without the need for a multi-axis manipulator.

After the right and left roller hemming mechanisms 76 and 78 have completed the hemming of the side edges of the hood assembly, the roller hemming mechanisms 76 and 78 are returned to the forward position of FIG. 1 and the upper platen 14 will be raised to the open position of FIG. 1. The completed hood assembly may then be removed from the press apparatus 10.

The foregoing description of the invention is merely exemplary in nature and, thus, variations thereof are intended to be within the scope of the invention. For example, roller hemming mechanisms may be the roller hemming mechanisms of U.S. Published Patent 2005-0284204 A1, or other roller mechanisms of the prior art. Furthermore, the hemming die mechanisms 44 and 46 may be chosen from the prior art, and are known to have various mechanical and hydraulic actuating mechanisms and to be mounted on the upper platen, lower platen, or elsewhere to reach inside the press.

Although the foregoing example performs the hemming die operation prior to the roller hemming operation, it may be desirable in some applications to perform the roller hemming operation prior to the hemming die operation.

Although the drawings show the example of a vehicle hood, it will be understood that the method and apparatus herein may also be used for other panel assemblies such as doors, rear closures, sunroof panels, fenders, and others. Although the drawings show the hemming die mechanisms at the front and rear of the hood assembly, and the roller hemming mechanisms at the side of the hood assembly, it may be desirable in some products to have the hemming die mechanisms at the side of the panel assembly and the roller hemming mechanisms at the front and rear of the panel assembly. Furthermore, in some applications, it may be desirable to have the hemming die mechanisms on only one side of the panel assembly and the roller hemming mechanisms at the other three sides. Or it may be desirable to have the hemming die mechanisms at the three sides of the panel assembly and the roller hemming mechanisms at one of the sides. Thus hemming die mechanisms may be employed on at least one side or portion of a side and the roller hemming mechanism employed on at least one side or side portion of the panel assembly.

The hemming die mechanism is not limited to the particular mechanism shown in the drawings, but rather may be a hemming die actuated by the various mechanical and hydraulic actuating mechanisms known in the industry. The track mechanism by be chosen from the various known devices such as a hydraulic mechanisms or a ball screw or a rack and pinion or other linear translation drive devices. The multi-axis manipulator may contain a drive motor that moves the multi-axis manipulator along the tracks 92. Or, alternatively, the tracks 92 may be driven fore and aft along side the lower platen to in turn move the multi-axis manipulator fore and aft. In addition, the roller hemming mechanism is not limited to being mounted on the track mechanism shown in the drawings, but rather may be a robotic or other mechanism known to manipulate a roller mechanism along a peripheral flange.

What is claimed is:

1. A method of hemming together the side edges of inner and outer panels by bending a peripheral flange of the outer panel over the edge portion of the inner panel to form a panel assembly; comprising:

providing a press apparatus having a stationary lower platen for supporting the outer panel and an upper platen that is raised and lowered relative to the tower platen;

loading the outer panel onto the lower platen and the inner panel onto the lower panel with the peripheral flange of the outer panel surrounding the inner panel and then lowering the upper platen to capture the inner panel atop the outer panel;

hemming at least a first portion of the peripheral flange by a hemming die mounted on the upper platen and closing over the first portion of the peripheral flange to bend the peripheral flange onto the inner panel upon the lowering of the upper platen;

and hemming at least a second portion of the peripheral flange by passing a roller hemming mechanism along the second portion of the peripheral flange while the inner panel remains captured atop the inner panel by the upper platen to bend the peripheral flange onto the inner panel.

2. The method of claim 1 further comprising said roller hemming mechanism having at least one roller carried by a multi-axis manipulator.

3. The method of claim 2 further comprising said multi-axis manipulator being mounted to ride upon a track extending along side the lower platen of the press.

4. The method of claim 1 further comprising the first portion of the peripheral flange being first and second side edges of the panels that are opposed to each other and the second portion of the of the peripheral flange being third and fourth side edges of the panels that are opposed to each other.

5. The method of claim 1 further comprising the first portion of the peripheral flange being first and second opposing side edges of the panels and the second portion of the peripheral flange being third and fourth opposing side edges of the panels.

6. The method of claim 1 further comprising said hemming die being operated to the closed position by the lowering motion of the upper platen.

7. The method of claim 1 further comprising said roller hemming mechanism having at least one roller carried by a multi-axis manipulator that rides on a track extending along side the lower platen of the press.

8. A method of hemming together the four side edges of inner and outer panels by bending a peripheral flange of the outer panel over the edge portions of the inner panel to form a panel assembly; comprising:

providing a press apparatus having a stationary lower platen for supporting the outer panel and an upper platen that is raised and lowered relative to the lower platen;

loading the outer panel onto the lower platen and the inner panel onto the lower panel with the peripheral flange of the outer panel surrounding the inner panel and then lowering the upper platen to capture the inner panel atop the outer panel;

hemming two opposing side edges of the inner and outer panels by closing hemming dies over the peripheral flange to bend the peripheral flange onto the inner panel;

and hemming the other two opposing side edges of the panel assembly by passing rollers along the peripheral flanges at the other two side edges to bend the flange onto the inner panel.

9. The method of claim 8 further comprising the passing of rollers along the peripheral flange while the hemming dies remain closed over the peripheral flange.

10. The method of claim 9 further comprising said rollers being mounted on a track mechanism that extends along side the alongside the peripheral flange.

11. The method of claim 10 further comprising said rollers being mounted on a track mechanism by a multi-axis manipulator.

12. A method of hemming together the edges of inner and outer panels by bending a peripheral flange of the outer panel over the side edge portions of the inner panel to form a panel assembly; comprising:

providing a press apparatus having a stationary lower platen for supporting the outer panel and an upper platen that is raised and lowered relative to the lower platen;

loading the outer panel onto the lower platen;

loading the inner panel onto the outer panel with the peripheral flange of the outer panel surrounding the inner panel;

lowering the upper platen to capture the inner panel atop the outer panel;

first hemming a first portion of the peripheral flange by closing hemming dies associates with the press apparatus over the first portion of the peripheral flange to bend the peripheral flange onto the edge portions of the inner panel;

and then hemming a second portion of the peripheral flange by passing a multi-axis-manipulated roller hemming mechanism progressively along a second portion of the peripheral flange while the hemming dies remain closed upon the peripheral flange;

and then raising the upper platen of the press to release the hemmed together panels.

13. Apparatus for hemming together the side edges of inner and outer panels by bending a peripheral flange of the outer panel over the edge portions of the inner panel to form a panel assembly; comprising:

a press apparatus having an upper platen that is raised and lowered and a stationary lower platen for supporting the outer panel with the inner panel loaded on top of the outer panel;

locating mechanism carried by the upper platen to engage with the inner panel and locate and hold the inner panel when the upper platen is lowered;

a hemming die mechanism having a hemming die for engaging with a first portion of the peripheral flange and bending the peripheral flange onto the inner panel;

and a hemming roller mechanism having a hemming roller that passes progressively along a second portion of the peripheral flange to and bending the second portion of the peripheral flange onto the inner panel.

14. The apparatus of claim 13 further comprising first and second hemming die mechanisms provided along each of first and second side edges of the panels and first and second roller hemming mechanisms provided along each of third and fourth side edges of the panels.

15. The apparatus of claim 13 further comprising said roller hemming mechanism having at least one roller mounted on a multi-axis manipulator.

16. The apparatus of claim 14 further comprising said multi-axis manipulator being mounted on a track mechanism that extends alongside the third and fourth edges of the panels.

17. The apparatus of claim 14 further comprising said hemming die mechanism having an actuator to close the hemming die and hold the panels while the roller hemming mechanism is actuated.

* * * * *